US011208746B2

(12) United States Patent
Dilo et al.

(10) Patent No.: US 11,208,746 B2
(45) Date of Patent: Dec. 28, 2021

(54) STRIPPER PLATE AND STITCHING PLATE FOR A NEEDLING MACHINE

(71) Applicant: Oskar Dilo Maschinenfabrik KG, Eberbach (DE)

(72) Inventors: Johann Philipp Dilo, Eberbach (DE); Joachim Leger, Eberbach (DE)

(73) Assignee: Oskar Dilo Maschinenfabrik KG

( * ) Notice: Subject to any disclaimer, the term of this patent is extended or adjusted under 35 U.S.C. 154(b) by 0 days.

(21) Appl. No.: 16/877,818

(22) Filed: May 19, 2020

(65) Prior Publication Data

US 2020/0378045 A1 Dec. 3, 2020

(30) Foreign Application Priority Data

May 29, 2019 (EP) ..... 19177216

(51) Int. Cl.
*D04H 18/02* (2012.01)

(52) U.S. Cl.
CPC ..... *D04H 18/02* (2013.01)

(58) Field of Classification Search
CPC ..... D04H 18/02; D04H 18/00; D04H 1/46; D04H 3/105; D04H 5/02; D04H 13/005; D04H 3/102
USPC ..... 28/115
See application file for complete search history.

(56) References Cited

U.S. PATENT DOCUMENTS 5,113,563 A * 5/1992 Feyerl ..... D04H 18/02 28/115
5,148,584 A * 9/1992 Fehrer ..... D04H 18/00 28/115
2008/0313873 A1 12/2008 Link et al.
2010/0162543 A1* 7/2010 Dilo ..... D04H 18/02 28/115

(Continued)

FOREIGN PATENT DOCUMENTS

AT 267 895 B 1/1969
EP 2 138 616 A1 12/2009

(Continued)

OTHER PUBLICATIONS

English language machine translation of FR 2878262 (Pub. May 2006); Legras, Rene et al; 12 pages.*

(Continued)

*Primary Examiner* — Amy Vanatta
(74) *Attorney, Agent, or Firm* — Jansson Munger McKinley & Kirby Ltd.

(57) ABSTRACT

The stripper plate or stitching plate for a needling machine comprises a plurality of opening arrangements, wherein each opening arrangement comprises at least one opening for accommodating needles of a needle row of a needle board of the needling machine. At least first and second opening arrangements of the plurality of opening arrangements are arranged at a slant to a longitudinal direction ($L_1$) of the stripper plate or stitching plate, and an absolute value of the angle (β) of the second opening arrangements to the longitudinal direction ($L_1$) of the stripper plate or stitching (Continued)

plate is different from an absolute value of an angle ($\alpha$) of the first opening arrangements to the longitudinal direction ($L_1$) of the stripper plate or stitching plate.

11 Claims, 3 Drawing Sheets

(56) References Cited

U.S. PATENT DOCUMENTS

2017/0130381 A1* 5/2017 Knopf ..... D04H 18/02

FOREIGN PATENT DOCUMENTS

| | | | | |
|---|---|---|---|---|
| EP | 3 165 660 A1 | 5/2017 | | |
| FR | 2874937 A3 * | 3/2006 | ..... | D04H 18/02 |
| FR | 2 878 262 A1 | 5/2006 | | |
| FR | 3 026 113 A1 | 3/2016 | | |

OTHER PUBLICATIONS

EP 19 17 7216 Search Report dated Nov. 8, 2019.
Nonwovens. Lünenschloss and Albrecht, Georg-Thieme-Verlag, Stuttgart, 1982, pp. 122-129.
Nonwovens. Albrecht, Fuchs, and Kittelmann, Wiley-VCH Verlag Weinheim, 2000, pp. 270 ff.

* cited by examiner

STRIPPER PLATE AND STITCHING PLATE FOR A NEEDLING MACHINE

FIELD OF THE INVENTION

The invention relates to a stripper plate and to a stitching plate for a needling machine for the needling of textile fabric such as nonwoven material, woven fabric, or interlaid scrim.

Needling machines are generally known and are described in, for example, *Vliesstoffe* [*Nonwovens*] by Lünenschloss and Albrecht, Georg-Thieme-Verlag, Stuttgart, 1982, pp. 122-129, and also in *Vliesstoffe* [*Nonwovens*] by Albrecht, Fuchs, and Kittelmann, Wiley-VCH Verlag Weinheim, 2000, pp. 270 ff.

When textile fabrics, especially nonwovens, are needled, it is desirable to achieve the most uniform possible needling, i.e., without the formation of patterns in the textile fabric.

SUMMARY OF THE INVENTION

It is an object of the invention to provide a stripper plate and a stitching plate for a needling machine and also a needling machine by means of which it is possible to produce a uniformly needled textile fabric even at a large feed-per-stroke ratio or over a relatively large range of feed rates through the needling machine.

According to an aspect of the invention, a stripper plate or a stitching plate for holding down or supporting a textile fabric in a needling machine for needling the textile fabric comprises a plurality of opening arrangements, wherein each opening arrangement of the plurality of opening arrangements comprises at least one opening and is configured to accommodate needles of one of the rows of needles of a needle board of the needling machine. At least first and second opening arrangements of the plurality of opening arrangements are arranged at a slant to a longitudinal direction of the stripper plate or stitching plate, which direction corresponds to a conveying direction of the textile fabric to be needled in the needling machine. An absolute value of the angle of the second opening arrangements of the plurality of opening arrangements to the longitudinal direction of the stripper plate or stitching plate is different from an absolute value of the angle of the first opening arrangements of the plurality of opening arrangements to the longitudinal direction of the stripper plate or stitching plate.

By varying the angles of the first and second opening arrangements to the longitudinal direction of the stripper plate or stitching plate, it becomes possible to arrange the rows of needles of the needle board of the needling machine correspondingly at different angles to the longitudinal direction of the stripper plate or stitching plate. As a result of the different distributions of the needles in the needle board thus achieved, the formation of patternings in the needled textile fabric can be prevented in the vast majority of cases even at high conveying speeds of the textile fabric in the needling machine. At the same time, an appropriately configured stripper plate or stitching plate prevents the needles of the needle board from pulling individual fibers or fiber bundles out of the textile fabric to an undesirable degree or even from pulling them out entirely from it. An appropriately configured stitching plate, furthermore, makes it possible for the needles to pass completely through the textile fabric in order to achieve the most thorough possible reorientation and thus homogeneous needling of the textile fabric without the danger that the needles could collide with the stitching plate supporting the textile fabric.

All of the opening arrangements of the plurality of opening arrangements are preferably configured as first or second opening arrangements, for which reason at least the first and second opening arrangements are covered in all of the descriptions of the opening arrangements given in the following. It is also conceivable that the plurality of opening arrangements could comprise third opening arrangements or additional opening arrangements, which are arranged at additional, different angles to the longitudinal direction of the stripper plate or stitching plate. It is also conceivable that the plurality of opening arrangements could also comprise opening arrangements which extend in the longitudinal direction of the stripper plate or stitching plate.

The opening arrangements of the plurality or opening arrangements are preferably elongated in form. This means that the opening arrangement is longer than it is wide. In addition, each opening arrangement extends lengthwise along a longitudinal axis, and the absolute value of the angle of the opening arrangement to the longitudinal direction of the stripper plate or stitching plate is defined as the angle between the longitudinal axis of the opening arrangement and an axis parallel to the longitudinal direction of the stripper plate or stitching plate.

With respect to the angles of the first and second opening arrangements, it is always the smaller of the two angles of intersection between the longitudinal axis of an opening arrangement and a line parallel to the longitudinal direction of the stripper plate or stitching plate which is considered, wherein the rotational direction is always to be defined as the direction proceeding from the parallel to the longitudinal direction of the stripper plate or stitching plate to the longitudinal axis of the opening arrangement. A counter-clockwise rotational direction (mathematically positive direction) is characterized by a plus sign, and a clockwise rotational direction (mathematically negative direction) is characterized by minus sign.

It is also preferred that each opening arrangement of the plurality of opening arrangements accommodate a plurality of the needles of one needle row of the needle board. Each opening arrangement of the plurality of opening arrangements can also accept all of the needles of a needle row. This formulation comprises two alternatives: first, that the at least one opening passes completely through the stripper plate or stitching plate and that the needles of the needle board can pass through the at least one opening. The second alternative is that the at least one opening does not pass completely through the stitching plate but rather is formed as a recess with a bottom. A recess such as this comprises an appropriate depth, so that the needles of the needle board pass through the textile fabric and then enter the at least one recess.

According to a first preferred embodiment, each of the opening arrangements of the plurality of opening arrangements comprises a single opening, which is configured at a slant to the longitudinal direction of the stripper plate or stitching plate. Such an opening then extends uninterruptedly along the longitudinal axis of the opening arrangement, which is itself oriented at an angle to the longitudinal direction of the stripper plate or stitching plate. An opening of this type, furthermore, is also preferably configured to accept all the needles of one row of needles of the needle board. This means that the opening is aligned with a needle row of the needle board, and that the opening is wide enough and long enough to accept the entire row of needles. As a result, the stripper plate or stitching plate comprises the fewest possible number of openings and can thus be produced easily and at low cost. In addition, the needles of a needle row can be arranged as closely together as possible.

According to a second preferred embodiment, each of the arrangements of openings of the plurality of opening arrangements comprises a plurality of openings, wherein each opening of the plurality of openings of an opening arrangement is configured at a slant to the longitudinal direction of the stripper plate or stitching plate, and the openings of an opening arrangement are arranged in a row extending in the longitudinal direction and thus in the direction of the longitudinal axis of the opening arrangement. The openings of the plurality of openings are then in each case configured with an elongated shape and are preferably oriented with respect to each other in such a way that their longitudinal axes line up and coincide with the longitudinal axis of the associated opening arrangement. Alternatively, the longitudinal axes of the plurality of openings of an opening arrangement can also be offset from each other, in which case, however, they are preferably configured so that they are parallel to each other and parallel to the longitudinal axis of the associated opening arrangement. In another modification of the second embodiment, the openings of an opening arrangement can also have a different geometry, e.g., a circular form, and be arranged in a row extending in the longitudinal direction and thus in the direction of the longitudinal axis of the opening arrangement.

In the second embodiment, the longitudinal axes of the plurality of openings of an opening arrangement are preferably arranged in each case at the same angle to the longitudinal axis of the stripper plate or stitching plate. Each opening is also configured to accept at least one needle or a portion of the needles of a needle row of the needle board. The plurality of openings are otherwise configured as described in general above or as described with reference to the first embodiment.

In the second embodiment, the stripper plate or stitching plate comprises more openings than in the case of the first embodiment, but, in comparison to a stripper plate or stitching plate with one opening for each needle, it will still always have fewer openings, so that it can be produced more easily and at lower cost. In addition, at least some of the needles of the needle row can be arranged as closely together as possible.

According to a third preferred embodiment, each of the opening arrangements of the plurality of opening arrangements comprises a plurality of openings, wherein each opening of the plurality of openings of an opening arrangement is configured so that it is parallel to the longitudinal direction of the stripper plate or stitching plate, and the openings of an opening arrangement are arranged in a row extending at a slant to the longitudinal direction of the stripper plate or stitching plate.

In the third embodiment, each of the openings of the plurality of openings has an elongated shape, so that its longitudinal axis is parallel to the longitudinal direction of the stripper plate or stitching plate. At the same time, the openings of the plurality of openings of an opening arrangement are offset from each other in the longitudinal direction of the stripper plate or stitching plate and in a transverse direction, i.e., transverse to the longitudinal direction of the stripper plate or stitching plate, in such a way that the openings form a row along the longitudinal axis of the associated opening arrangement, this row being oriented at a slant to the longitudinal direction of the stripper plate or stitching plate. This means that a predefined point of each opening, e.g., a center point or an apex point of each opening, is arranged on the longitudinal axis. Each opening of the plurality of openings of an opening arrangement is configured to accept preferably one needle of a needle row of the needle board, but it can also accept a plurality of needles and thus a certain portion of the needles of a needle row of the needle board. The plurality of openings are configured otherwise as previously described in general or as described with reference to the first and second embodiments.

Because each opening of the plurality of openings of an opening arrangement is parallel to the longitudinal direction of the stripper plate or stitching plate, the length of the openings is substantially freely selectable and can, independently of the angle of the opening arrangement in question to the longitudinal direction of the stripper plate or stitching plate, make possible a desired horizontal stroke of the needles. The width of the openings can always be kept small enough to allow them to fulfill their function of holding back the fibers, i.e., of stripping the fibers from the needles.

The plurality of opening arrangements of a stripper plate or stitching plate can be configured according to a single embodiment or can comprise opening arrangements of different embodiments in any desired combinations.

The opening arrangements of the plurality of opening arrangements are preferably arranged in a plurality of blocks, wherein all of the opening arrangements of one block of the plurality of blocks are parallel to each other. Each block of the plurality of blocks comprises a plurality of opening arrangements, wherein these opening arrangements preferably form a row, which preferably extends in the transverse direction of the stripper plate or stitching plate. The blocks of the plurality of blocks are preferably arranged one behind the other in the longitudinal direction of the stripper plate or stitching plate.

To increase the homogenization of the stitching pattern in the needled textile fabric, it is effective to arrange the rows of needles and thus the plurality of blocks of opening arrangements in a herringbone pattern. This is to be understood as an arrangement in which the opening arrangements of the individual blocks are arranged at a slant to the longitudinal direction of the stripper plate or stitching plate in such a way that the angle of the opening arrangements of a block to the longitudinal direction has a certain sign (plus or minus), and the angle of the opening arrangements of a block adjacent to it in the longitudinal direction of the stripper plate or stitching plate has the opposite sign (minus or plus). The angles of the opening arrangements of successive blocks can have the same value, as a result of which a homogeneous herringbone pattern is formed in areas of the stripper plate or stitching plate. The angles of the opening arrangements of successive blocks can also have different values, however.

In a preferred embodiment, the opening arrangements of at least one first block of the plurality of blocks are configured differently from the opening arrangements of at least one second block of the plurality of blocks of opening arrangements. This makes it possible to vary the needling in a wide variety of ways and thus leads to an especially homogeneous stitching pattern in the textile fabric with the fewest possible defects. The opening arrangements of the first block and of the second block can differ, for example, in that they correspond to first or second opening arrangements, in that they are arranged in a herringbone pattern and thus have different angles of inclination relative to the longitudinal direction of the stripper plate or stitching plate, and/or in that the first block comprises opening arrangements of one of the first three embodiments, and the second block comprises opening arrangements of one of the other two embodiments of the three. It is also conceivable that the opening arrangements of the first and second blocks could have different widths and/or different lengths or that one block comprises differently configured opening arrangements.

It has been found to be especially preferable for the absolute value of the angle of the first opening arrangements to the longitudinal direction of the stripper plate or stitching plate to be between 10° and 30°, preferably between 15° and 25°, and especially preferably between 17° and 23°.

It has also been found advantageous for the absolute value of the angle of the second opening arrangements to the longitudinal direction of the stripper plate or stitching plate to be between 25° and 65°, preferably between 30° and 60°, and especially preferably between 42° and 48°.

A row of needles of a needle board usually comprises between 5 and 40 needles. The needles of one row can be connected to each other, in which case they form a needle module, which is arranged in a slot in the needle board. The length of an opening arrangement of the plurality of opening arrangements corresponds preferably to the length of a needle row and thus depends on the number of needles per needle row of the needle board and on the spacing of the needles within the row.

The width of the at least one opening of an opening arrangement of the plurality of opening arrangements is preferably large enough to prevent reliably the accommodated needles from colliding with the stripper plate or stitching plate even at very high stroke frequencies of, for example, more than 1,500 strokes/minute. In addition, the width is, at the same time, small enough to guarantee that the fibers adhering to the needles of the needle board will be stripped off by the stripper plate. The width of an opening thus depends substantially on the diameter of the needle and on the diameter of the fiber. The width of the at least one opening is preferably no more than 12 mm, preferably no more than 8 mm, more preferably no more than 6 mm.

It has also been found that the distortions within the textile fabric can be reduced even more if the needles of a needle board execute a horizontal stroke. This means that the needles execute a stroking movement in the conveying direction of the textile fabric to be needled while they are at least partially present in the textile fabric. As a result, relative movement in the conveying direction between the fibers of the textile fabric and the needles is minimized, and thus the danger of distortions is reduced. At least certain sections of the at least one opening of the plurality of opening arrangements therefore preferably extend by a predetermined amount parallel to the longitudinal direction of the stripper plate or stitching plate and are configured to make possible a predetermined horizontal stroke of needles of the needle board.

The distance value by which an opening extends parallel to the longitudinal direction of the stripper plate or stitching plate is greater than the desired or predetermined value of the horizontal stroke of the needles of the needle board. In addition to the value of the horizontal stroke of the needle, it is also necessary in particular to take into account the diameter of the needle and to ensure enough tolerance to prevent the needles from colliding with the stripper plate or stitching plate. Depending on the embodiment of the plurality of opening arrangements, this requirement leads to the result that the at least one opening of the plurality of opening arrangements must be either long enough or wide enough to extend by the predetermined value parallel to longitudinal direction of the stripper plate or stitching plate.

If the plurality of opening arrangements is configured according to the first or second embodiment, the minimum width of the at least one opening is therefore preferably obtained by multiplying the predetermined value by the sine of the angle between the associated opening arrangement and the longitudinal direction of the stripper plate or stitching plate.

If the plurality of opening arrangements is configured according to the third embodiment, the length of the at least one opening preferably has a value which corresponds at least to the predetermined value.

It can also be derived simultaneously from the above-described requirement on the maximum width of the at least one opening that, in opening arrangements according to the first and second embodiments, there are limits on the angle between the opening arrangement in question and the longitudinal direction of the stripper plate or stitching plate and also on the predetermined value of the extent of the opening in the longitudinal direction of the stripper plate or stitching plate.

Starting from a certain angle between the opening arrangement in question and the longitudinal direction of the stripper plate or stitching plate, therefore, there is preferably a transition from opening arrangements of the first or second embodiment to opening arrangements according to the third embodiment. Opening arrangements according to the third embodiment make it possible, without changing the width, to increase both the angle of the opening arrangement in question and the predetermined value of the extent in the longitudinal direction of the stripper plate or stitching plate and thus to increase the possible horizontal stroke of the needles.

The sine of the angle between the longitudinal axis of an opening arrangement and a line parallel to the longitudinal direction of the stripper plate or stitching plate is obtained from the ratio of the width of the opening arrangement to the predetermined value of the longitudinal extent. If, for example, the maximum width is fixed at 3 mm, and if a predetermined value of 6 mm is desired, then the sine is found to be 0.5. The maximum angle at which an opening arrangement according to the first and second embodiments can be arranged in order to fulfill this requirement is found correspondingly to be 30°. If the maximum width is not to be exceeded, opening arrangements with a larger angle to the longitudinal direction of the stripper plate or stitching plate are to be configured according to the third embodiment.

It has been found to be especially effective for the horizontal stroke of the needles of the needle board and the predetermined value of the extent of the at least one opening of the plurality of opening arrangements parallel to the longitudinal direction to be between 2 and 12 mm, preferably between 4 and 8 mm.

It is obvious that this principle also includes all intermediate values, preferably in steps of 0.5 mm.

According to another aspect of the invention, a needling machine for needling a textile fabric comprises a needle board comprising a plurality of rows of needles, which are arranged at a slant to a longitudinal direction of the needle board, which direction corresponds to a conveying direction of the textile fabric to be needled in the needling machine, and a stripper plate and/or stitching plate as previously described.

In this way, a needling machine is provided which exhibits the previously described features and offers the cited advantages.

Finally, it is preferable for each opening arrangement of the plurality of opening arrangements to be aligned with a needle row of the plurality of needle rows of the needle board, so that the at least one opening of the associated opening arrangement can accommodate needles of the needle row of the needle board.

The term "nonwoven" is well known in the relevant industry and for purposes of this application the term "nonwoven" will be given its customary meaning. "Nonwoven" means and refers to a material "made of fibers held together by interlocking or bonding."

DETAILED DESCRIPTION OF SPECIFIC EMBODIMENTS

Figure 1:
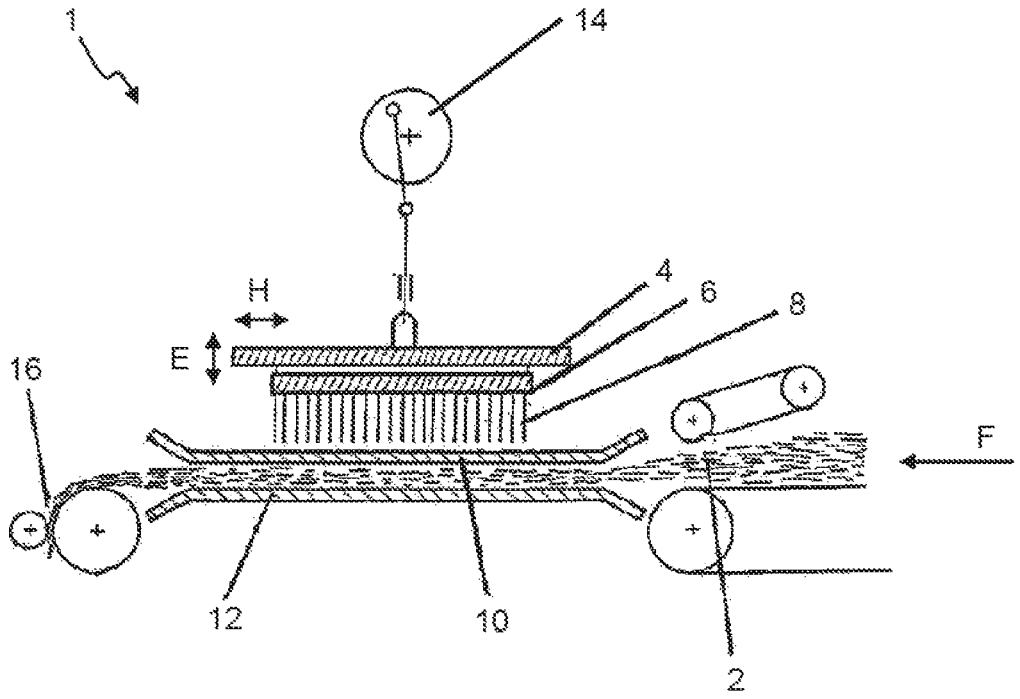
FIG. 1 shows a schematic side view of the essential components of a needling machine.

FIG. 1 shows a schematic diagram of the structure of a needling machine 1 from the side. A textile fabric 2 such as a web of nonwoven material is supplied to the entrance to the needling machine 1 and conveyed to a needling zone. A needle bar 4, to which a needle board 6 is attached, is arranged in the area of the needling zone; needles 8 for solidifying the fabric 2 are mounted on the needle board. In this area, the textile fabric 2 to be needled is guided between a stripper plate 10, which holds the textile fabric 2 down, and a stitching plate 12, which supports the textile fabric 2 from underneath in the needling zone. The needles 8 solidify the fabric 2, in that they are pushed at high frequency into the textile fabric 2 and pulled back out again. During this process, the needles 8 usually pass through openings in the stripper plate 10 and in the stitching plate 12. The stitching plate 12, however, can also comprise openings which do not pass all the way through the plate but which are instead only deep enough to accommodate the tips of the needles 8 passing through the fabric 2. A drive 14, which is configured as a connecting rod drive, for example, is preferably provided to move the needles 8 up and down in a stitching direction E.

To prevent the fabric 2 from becoming distorted as the fabric is being moved further onward in a conveying direction F while the needles 8 are still present in the fabric 2, the needle board 6 with the needles 8, in a preferred embodiment of a needling machine 1, executes a horizontal stroke H parallel to the conveying direction F. The needle board 6 with the needles is movable in the conveying direction F along with the textile fabric 2. Especially while the needles 8 are present in the fabric 2, the needles 8 are moved along with the fabric 2 to minimize the relative movement between the needles 8 and the fabric 2. To bring about the horizontal stroke H, either a secondary drive acting on the needle board 6 can be provided, or the drive 14, in a manner familiar to the skilled person, can be configured appropriately, i.e., coupled to the needle bar 4 in a certain way.

The resulting product is a solidified textile fabric 16 such as a nonwoven. The skilled person is familiar with a wide variety of types of needling machines 1, including the double needling machine, in which needling is carried out from above and from below by means of two needle bars; needling machines with a horizontal stroke; and needling machines without a horizontal stroke. It is obvious that the present invention can be applied to various types of needling machines and is not limited to the embodiment of a needling machine 1 described herein. For example, in the case of double needling machines, the stitching plate 12 serves simultaneously as the stripper plate for a needle bar arranged under the fabric 2.

The needles of a needle board 6 are usually arranged in rows of between 5 and 40 needles. The rows of needles are preferably arranged at a slant to a longitudinal direction of the needle board 6, which direction is parallel to the conveying direction F of the fabric 2 in the needling machine.

Especially with respect to their arrangement and possibly also with respect to their shape, the openings in the stripper plate preferably correspond to the openings in the stitching plate 12. The present invention can therefore be explained in the following on the basis of the parts of the single plate shown in FIGS. 2 and 3 and will apply equally to a stripper plate 10 and to a stitching plate 12.

Figure 2:
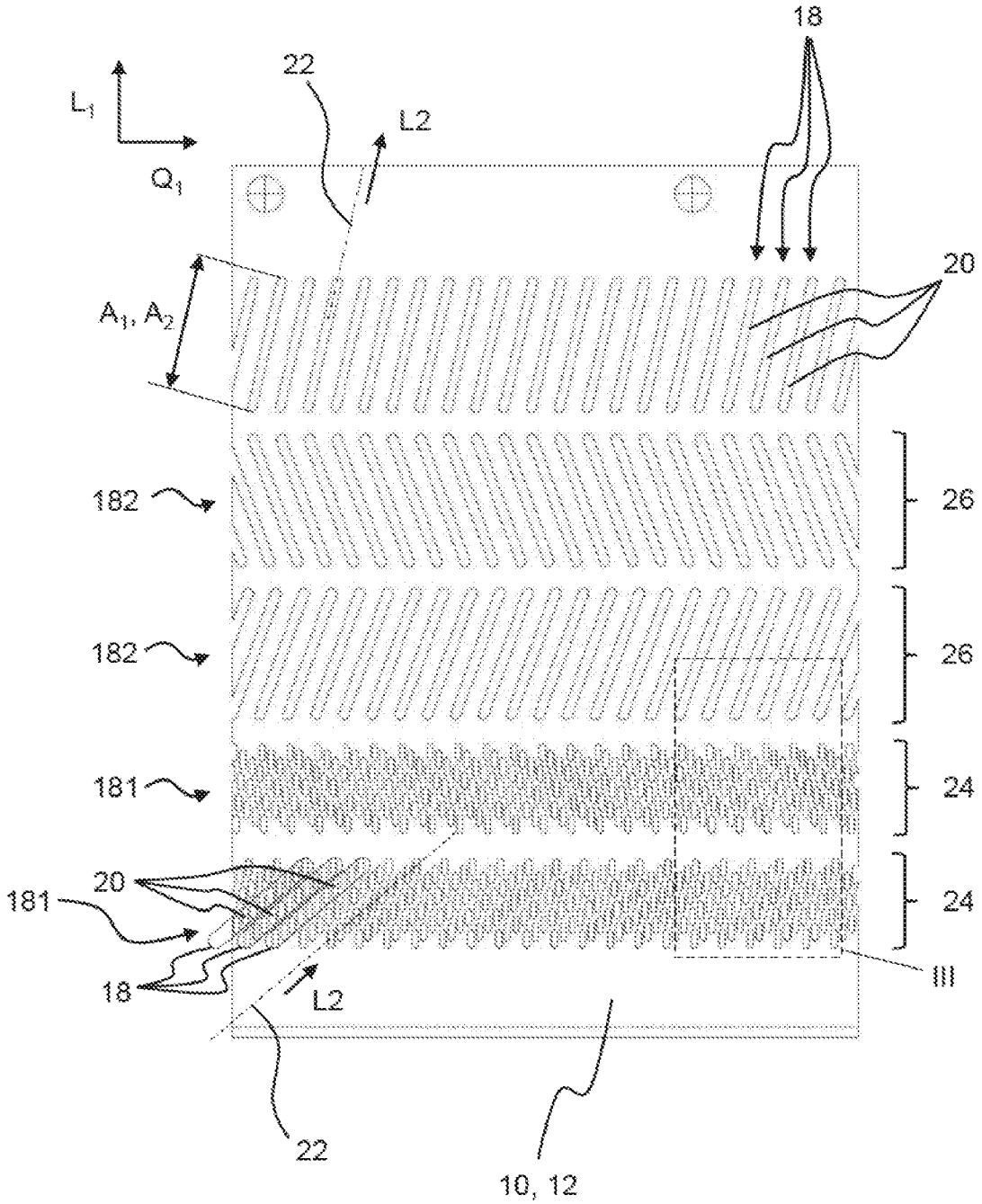
FIG. 2 shows a top view of part of a stripper plate or stitching plate according to the invention.
Figure 3:
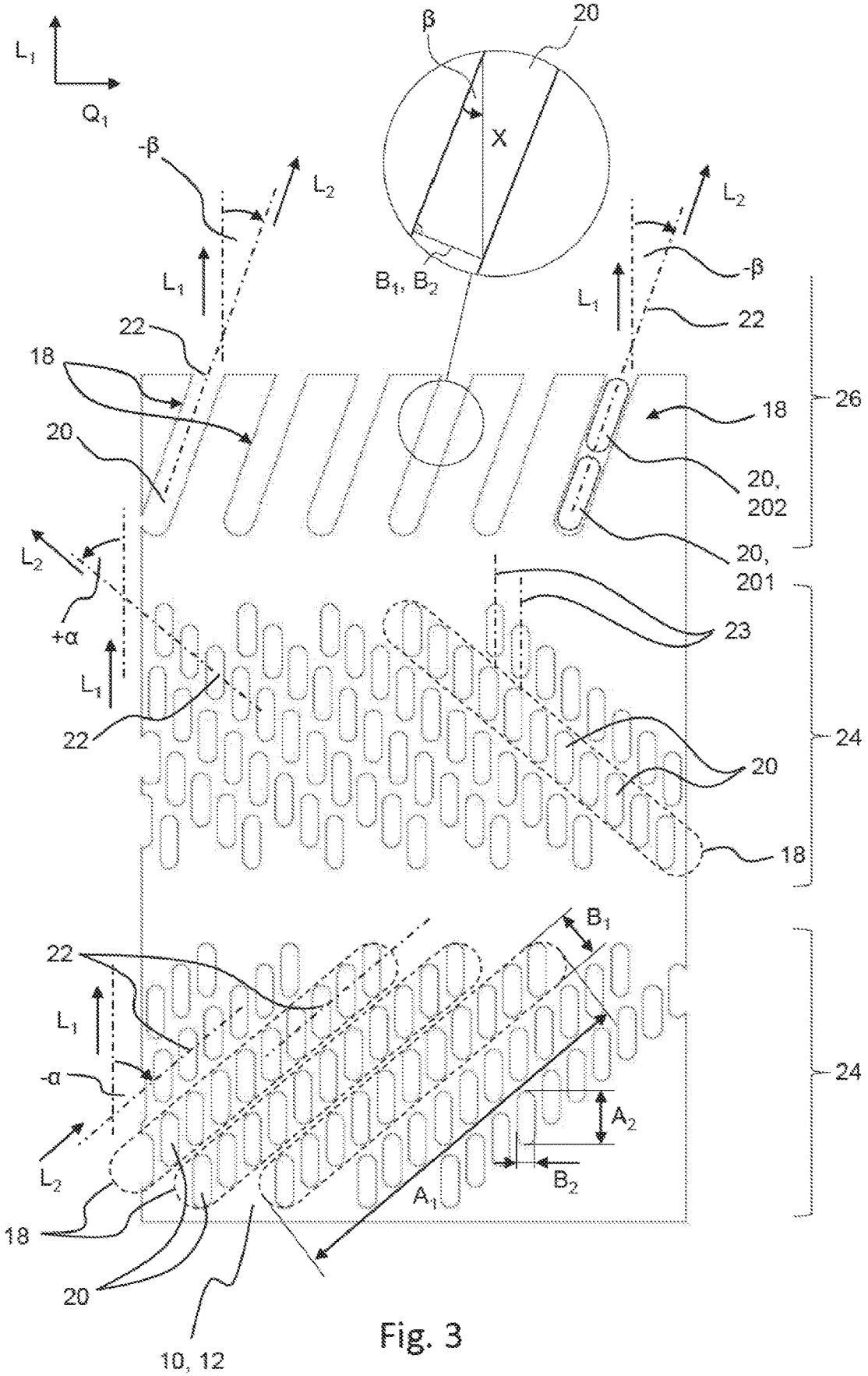
FIG. 3 shows a view of a detail of the stripper plate or stitching plate according to FIG. 2.

Each of FIGS. 2 and 3 shows a part of a stripper plate 10 or stitching plate 12 according to the invention, wherein the part according to FIG. 3 corresponds approximately to the area in FIG. 2 characterized by the reference symbol III.

The stripper plate 10 or stitching plate 12 comprises a plurality of opening arrangements 18. Each opening arrangement 18 comprises at least one opening 20 and is configured to accept one row of needles of the needle board 6 of the needling machine 1. At least first and second opening arrangements 181, 182, furthermore, of the plurality of opening arrangements 18 are arranged at a slant to a longitudinal direction $L_1$ of the stripper plate 10 or stitching plate 12, which direction corresponds to the conveying direction F of the fabric 2 to be needled in the needling machine. An absolute value of an angle $\beta$ of the second opening arrangements 182 of the plurality of opening arrangements 18 to the longitudinal direction $L_1$ of the stripper plate 10 or stitching plate 12 is different from an absolute value of the angle $\alpha$ of the first opening arrangements 181 of the plurality of opening arrangements 18 to the longitudinal direction $L_1$ of the stripper plate 10 or stitching plate 12.

In the embodiment shown here, all of the opening arrangements 18 are configured either as first or as second opening arrangements 181, 182. As explained above, however, it is also possible to provide in addition any other desired opening arrangements 18.

The opening arrangements 18 comprise a length $A_1$ and a width $B_1$, wherein the length $A_1$ is greater than the width $B_1$, so that the opening arrangements 18 have an elongated shape. The opening arrangements 18, furthermore, extend with respect to their length $A_1$ along a longitudinal axis 22, which defines a longitudinal direction $L_2$ of the opening arrangement 18 in question. The angles $\alpha$, $\beta$ of the plurality of opening arrangements 18 to the longitudinal direction $L_1$ of the stripper plate 10 or stitching plate 12 are defined as the angles between the longitudinal axis 22 in question and a line parallel to the longitudinal direction $L_1$.

The opening arrangements 18 of the plurality of opening arrangements 18 can be configured in a wide variety of different ways. As one example, it is possible to provide, next to first opening arrangements 181 and second opening arrangements 182, which differ with respect to the angle between their associated longitudinal axis 22 and the longitudinal direction $L_1$ of the stripper plate or stitching plate 10, 12, third and additional opening arrangements which are at angles to the longitudinal direction $L_1$ which are different from angles $\alpha$ and $\beta$. As another example, the opening arrangement 18, including the first opening arrangements 181, the second opening arrangements 182, or optional additional opening arrangements, can be configured in accordance with one of the embodiments explained below.

According to a first embodiment, an opening arrangement 18 comprises a single opening 20, which is arranged at a slant to the longitudinal direction $L_1$ of the stripper plate or stitching plate 10, 12. This opening 20 then has an uninterrupted shape extending along the longitudinal axis 22 of the opening arrangement 18, wherein the longitudinal axis 22 is oriented at a slant to the longitudinal direction $L_1$ of the stripper plate 10 or stitching plate 12. In FIGS. 2 and 3, the second opening arrangements 182 are configured according to this first embodiment. The opening 20 preferably comprises a length $A_2$ which corresponds to the length $A_1$ of the associated opening arrangement 18 and which is designed to accommodate a row of needles 8 of the needle board 6 of the needling machine 1.

FIG. 3 shows by way of example two openings 201 and 202 representing the openings 20 of an opening arrangement 18 according to a second embodiment. Such an opening arrangement 18 comprises a plurality of openings 20 or 201, 202, wherein each of the openings 20, 201, 202 is arranged at a slant to the longitudinal direction $L_1$ of the stripper plate or stitching plate 10, 12. In addition, the openings 20, 201, 202 of this opening arrangement 18 are arranged in a row in the longitudinal direction $L_2$ of the opening arrangement 18, i.e., along its longitudinal axis 22.

Each of the openings 201, 202 has an elongated shape and comprises a longitudinal axis. The openings 201, 202 are preferably oriented with respect to each other in such a way that their longitudinal axes are aligned with each other. The longitudinal axes of the openings 201, 202 preferably also coincide with the longitudinal axis 22 of the opening arrangement in question.

The openings 20 or 201, 202 according to an opening arrangement 18 of the second embodiment preferably comprise a length which is designed to accommodate at least one needle and preferably a greater part of the needles 8 of a row of needles of the needle board 6.

Each of the opening arrangements 18 according to a third embodiment comprises a plurality of openings 20, each opening 20 of which is arranged parallel to the longitudinal direction $L_1$ of the stripper plate or stitching plate 10, 12. In addition, the openings 20 of an opening arrangement 18 of the third embodiment are arranged in a row which is at a slant to the longitudinal direction $L_1$ of the stripper plate or stitching plate 10, 12.

In FIGS. 2 and 3, the first opening arrangements 181 are configured in accordance with the third embodiment. The longitudinal axis 23 of each of these openings 20 is parallel to the longitudinal direction $L_1$ of the stripper plate or stitching plate 10, 12. In addition, the openings 20 in this embodiment are offset from each other both in the longitudinal direction $L_1$ and in the transverse direction $Q_1$ of the stripper plate or stitching plate 10, 12, in such a way that they form a row along the longitudinal axis 22 of the opening arrangement 18 in question.

The openings 20 of an opening arrangement 18 according to the third embodiment are preferably dimensioned in such a way that each one accepts one needle 8 of a needle row of the needle board 6. The openings 20 can also be dimensioned in such a way, however, that they accommodate two or more adjacent needles 8 of a needle row or needles of several needle rows arranged one behind the other.

A stripper plate or stitching plate 10, 12 according to the invention can comprise opening arrangements according to only one of these embodiments, or it can comprise any desired combinations of opening arrangements 18 of different embodiments. In particular, alternative embodiments of opening arrangements 18 which are nevertheless arranged according to the invention are also conceivable.

Unless otherwise described, the configurations and features described herein pertain to all of the embodiments of opening arrangements 18.

The opening arrangements 18 of the plurality of opening arrangements 18 can be arranged in a plurality of blocks 24, 26. The opening arrangements 18 of a block 24, 26 are preferably arranged parallel to each other and form a row of opening arrangements 18 which extends in the transverse direction $Q_1$ of the stripper plate or stitching plate 10, 12. The blocks 24, 26 are then arranged one behind the other in the longitudinal direction $L_1$ of the stripper plate or stitching plate 10, 12. In the transverse direction $Q_1$ of the stripper plate or stitching plate 10, 12, the blocks 24, 26 can extend over the entire width of the stripper plate or stitching plate 10, 12 in question or over only portions of them.

According to the preferred embodiment according to FIGS. 2 and 3, the opening arrangements 18 of the blocks 24, 26 are arranged in a herringbone pattern. The angle of all the opening arrangements 18 of a block 24, 26 to the longitudinal direction $L_1$ comprises a specific sign (plus or minus), which is the opposite (minus or plus) of the angle of all the opening arrangements 18 of an adjacent block 24, 26, i.e., adjacent in the longitudinal direction $L_1$. The opening arrangements 18 of successive blocks 26 and 26 or 24 and 24 have the same absolute value for this angle, whereas the opening arrangements 18 of successive blocks 24 and 26 have different absolute values for this angle.

In the case of the stripper plate or stitching plate 10, 12 illustrated in FIGS. 2 and 3, a first block 24 comprises first opening arrangements 181 of the plurality of opening arrangements 18, and a second block 26 comprises second opening arrangements 182 of the plurality of opening arrangements 18. In addition, the opening arrangements 18, 181 of the first block 24 are configured in accordance with the third embodiment, whereas the opening arrangements 18, 182 of the second block 26 are configured in accordance with the first embodiment. Various combinations are conceivable here as alternatives.

Regardless of how an opening 20 is configured, it has a width $B_2$, which must be large enough to prevent reliably the at least one needle 8 to be accommodated in this opening 20 from colliding with the stripper plate or stitching plate 10, 12 in the area of this opening 20. The width $B_2$ of an opening 20 is therefore greater than the diameter of a needle 8 to be accommodated. At the same time, the width $B_2$ of an opening 20 must be small enough that the stripping-off of adhering fibers from the needles 8 by the stripper plate or stitching plate 10, 12 is guaranteed.

To make it possible for the needle board 8 and the needles 8 to execute a horizontal stroke H, at least certain sections of the at least one opening 20 of the plurality of opening arrangements 18 preferably extend by a predetermined value X parallel to the longitudinal direction $L_1$ of the stripper plate 10 or stitching plate 12 and are designed to allow the needles 8 to execute the predetermined horizontal stroke H. As a result, the needles 8 are given sufficient freedom of movement in the longitudinal direction $L_1$ of the stripper plate 10 or stitching plate 12 and thus in the conveying direction F of the textile fabric 2 so that they can execute a horizontal stroke H.

It follows from this that the value X of the distance parallel to the longitudinal direction $L_1$ should be greater than the desired or predetermined value of the horizontal stroke H of the needles 8.

Depending on the configuration of the plurality of opening arrangements 18, different requirements are thus imposed on their dimensions. In particular, the openings 20 of the plurality of opening arrangements 18 must either be long enough or wide enough to allow them to extend by the predetermined distance value X parallel to the longitudinal direction $L_1$ of the stripper plate 10 or stitching plate 12.

In the case of opening arrangements 18 according to the first and second embodiments, the openings 20 provided in each case are at a slant to the longitudinal direction $L_1$ of the stripper plate 10 or stitching plate 12. The value X of the distance by which an opening 20 extends in the longitudinal direction $L_1$ of the stripper plate or stitching plate 10, 12 therefore depends on the width $B_2$ of the associated opening 20. The length $A_2$ of the opening however, is less limiting with respect to the value X, but it must also be taken into account especially in the case of the second embodiment.

As can be derived from the detailed view of an opening 20 of an opening arrangement contained in FIG. 3, a minimum width $B_2$ stands in a certain relationship to the predetermined value X by way of the angles α, β between the longitudinal direction $L_1$ of the stripper plate 10 or stitching plate 12 and the longitudinal axis 22 of the associated opening arrangement 18. The mathematical relationship between the angles α or β, the width $B_2$, and the value X is found to be:

$$\sin(\alpha,\beta)=B_2/X.$$

Correspondingly, a minimum width $B_2$ for a desired predetermined value X is obtained by multiplying the sine of the angle α, β in question by the value X. By proceeding in the opposite direction, one can use this relationship to determine a maximum angle at which a maximum allowable width can still be reached for a predetermined value X.

It is obvious that, as the value of the angle α, β increases, the required width $B_2$ of an opening 20 increases in order to reach the same predetermined value X of the distance in the longitudinal direction $L_1$ of the stripper plate or stitching plate 10, 12. Because, starting from a certain width $B_2$ of an opening 20, e.g., a width of greater than 6 mm, the function of the stripper plate 10 or stitching plate 12 is not reliably fulfilled in all cases, there is a limit on the maximum value X of the distance in the longitudinal direction $L_1$ of the openings 20 of these opening arrangements 18 which can be achieved with the opening arrangements 18 according to the first and second embodiments.

So that it is possible to obtain large values X of the distance in the longitudinal direction $L_1$ or larger angles α, β of the opening arrangements 18 to the longitudinal direction $L_1$ of the stripper plate or stitching plate 10, 12, the openings 20 of the opening arrangements 18 can therefore be configured in accordance with the third embodiment.

The openings 20 of the opening arrangements 18 according to the third embodiment are parallel to the longitudinal direction $L_1$ of the stripper plate or stitching plate 10, 12. The key factor in their ability to allow a horizontal stroke H of the needles 8 in the conveying direction F is therefore substantially the length $A_2$ of the openings 20. The length $A_2$ of an opening 20 therefore corresponds preferably at least to the predetermined value X of the distance in the longitudinal direction $L_1$. As a result, the openings 20 can be made narrow, i.e., their width $B_2$ can be reduced, whereas they simultaneously can be adapted by way of their length $A_2$ to the desired horizontal stroke H.

Because the various openings 20 of an opening arrangement 18 according to the third embodiment are at the same time arranged along the longitudinal axis 22 of the opening arrangement 18, which is itself oriented at a slant to the longitudinal direction $L_1$ of the stripper plate or stitching plate 10, 12, it is simultaneously made possible for the associated row of needles of the needle board 6 also to be arranged at a slant to the longitudinal direction $L_1$ or to the conveying direction F of the textile fabric 2 in the needling machine in order to achieve a textile fabric which has been needled with the greatest possible uniformity.

The invention claimed is:

1. A stripper plate or stitching plate for holding down or supporting a textile fabric in a needling machine for needling the textile fabric, wherein the stripper plate or stitching plate comprises a plurality of opening arrangements;

wherein each opening arrangement of the plurality of opening arrangements comprises a plurality of openings and is configured to accommodate needles of one row of needles of a needle board of the needling machine;

wherein at least first and second opening arrangements of the plurality of opening arrangements are arranged at a slant to a longitudinal direction ($L_1$) of the stripper plate or stitching plate, wherein the longitudinal direction ($L_1$) of the stripper plate or stitching plate corresponds to a conveying direction of the fabric to be needled in the needling machine;

wherein each opening of the plurality of openings is configured to be parallel to the longitudinal direction ($L_1$) of the stripper plate or stitching plate, and wherein the openings of an opening arrangement are arranged in a row which extends at a slant to the longitudinal direction ($L_1$) of the stripper plate or stitching plate; and wherein an absolute value of an angle (β) of the second opening arrangements of the plurality of opening arrangements to the longitudinal direction ($L_1$) of the stripper plate or stitching plate is different from an absolute value of an angle (α) of the first opening arrangements of the plurality of opening arrangements to the longitudinal direction ($L_1$) of the stripper plate or stitching plate.

2. The stripper plate or stitching plate of claim 1 wherein the opening arrangements of the plurality of opening arrangements are arranged in a plurality of blocks, wherein all of the opening arrangements of a block of the plurality of blocks are parallel to each other.

3. The stripper plate or stitching plate of claim 2 wherein the plurality of blocks of opening arrangements are arranged in a herringbone pattern.

4. The stripper plate or stitching plate of claim 2 wherein the opening arrangements of at least one first block of the plurality of blocks are configured differently from the opening arrangements of at least one second block of the plurality of blocks of opening arrangements.

5. The stripper plate or stitching plate of claim 1 wherein the absolute value of the angle of the first opening arrangements to the longitudinal direction ($L_1$) of the stripper plate or stitching plate is between 10° and 30°.

6. The stripper plate or stitching plate of claim 1 wherein the absolute value of the angle (β) of the second opening arrangements to the longitudinal direction ($L_1$) of the stripper plate or stitching plate is between 25° and 65°.

7. The stripper plate or stitching plate of claim 1 wherein at least a certain section of the openings of the plurality of opening arrangements is parallel to the longitudinal direction ($L_1$) of the stripper plate or stitching plate over a predetermined distance value (X) and is thus configured to allow for a predetermined horizontal stroke of needles of a needle board.

8. The stripper plate or stitching plate of claim 7 wherein each opening comprises a length ($A_2$), wherein a value of the length ($A_2$) corresponds to the predetermined distance value (X).

9. The stripper plate or stitching plate of claim 7 wherein the predetermined distance value (X) is between 2 and 12 mm.

10. A needling machine for needling a textile fabric, comprising:

a needle board, which comprises a plurality of rows of needles, wherein at least some of the rows are arranged at a slant to a longitudinal direction ($L_1$) of the needle board, wherein the longitudinal direction ($L_1$) of the needle board corresponds to a conveying direction of the fabric to be needled in the needling machine; and a stripper plate or stitching plate for holding down or supporting the textile fabric in the needling machine, wherein the stripper plate or stitching plate comprises a plurality of opening arrangements;

wherein each opening arrangement of the plurality of opening arrangements comprises a plurality of openings and is configured to accommodate needles of one row of needles of the needle board of the needling machine;

wherein at least first and second opening arrangements of the plurality of opening arrangements are arranged at a slant to the longitudinal direction ($L_1$) of the stripper plate or stitching plate, which corresponds to the longitudinal direction ($L_1$) of the needle board, wherein the longitudinal direction ($L_1$) of the stripper plate or stitching plate corresponds to a conveying direction of the fabric to be needled in the needling machine;

wherein each opening of the plurality of openings is configured to be parallel to the longitudinal direction ($L_1$) of the stripper plate or stitching plate, and wherein the openings of an opening arrangement are arranged in a row which extends at a slant to the longitudinal direction ($L_1$) of the stripper plate or stitching plate; and wherein an absolute value of an angle ($\beta$) of the second opening arrangements of the plurality of opening arrangements to the longitudinal direction ($L_1$) of the stripper plate or stitching plate is different from an absolute value of an angle ($\alpha$) of the first opening arrangements of the plurality of opening arrangements to the longitudinal direction ($L_1$) of the stripper plate or stitching plate.

11. The needling machine of claim 10 wherein each opening arrangement of the plurality of opening arrangements is aligned with a needle row of the plurality of needle rows of the needle board in order to make it possible for each opening of the associated opening arrangement to accommodate needles of the needle row.

* * * * *